US009221521B2

(12) United States Patent
Ma et al.

(10) Patent No.: US 9,221,521 B2
(45) **Date of Patent: *Dec. 29, 2015**

(54) APPARATUS AND ANCHOR HANDLING VESSELS FOR INSTALLING OR REMOVING AND REPLACING A SEGMENT OF A MOORING LINE

(71) Applicant: Chevron U.S.A. Inc., San Ramon, CA (US)

(72) Inventors: Kai-tung Ma, Spring, TX (US); Peter Waerness, Brekkesto (NO)

(73) Assignee: Chevron U.S.A. Inc., San Ramon, CA (US)

( * ) Notice: Subject to any disclaimer, the term of this patent is extended or adjusted under 35 U.S.C. 154(b) by 271 days.

This patent is subject to a terminal disclaimer.

(21) Appl. No.: 13/937,862

(22) Filed: Jul. 9, 2013

(65) Prior Publication Data

US 2014/0014018 A1 Jan. 16, 2014

Related U.S. Application Data

(60) Provisional application No. 61/669,925, filed on Jul. 10, 2012.

(51) Int. Cl.

| | |
|---|---|
| ***B63B 21/04*** | (2006.01) |
| ***B63B 21/16*** | (2006.01) |
| ***B63B 21/08*** | (2006.01) |
| ***B63B 21/20*** | (2006.01) |
| ***B63B 21/50*** | (2006.01) |
| *B63B 21/00* | (2006.01) |

(52) U.S. Cl.

CPC ..... *B63B 21/04* (2013.01); *B63B 21/08* (2013.01); *B63B 21/16* (2013.01); *B63B 21/20* (2013.01); *B63B 21/50* (2013.01); *B63B 2021/003* (2013.01); *B63B 2021/007* (2013.01)

(58) Field of Classification Search

CPC ..... B63B 21/00; B63B 2021/003; B63B 2021/007; B63B 21/04; B63B 21/08; B63B 21/16; B63B 21/18; B63B 21/20; B63B 2021/203; B63B 21/22; B63B 21/50

USPC ..... 114/293, 230.2–230.26, 230.1; 405/158, 166, 168.4, 172, 173, 195.1, 405/224, 224.4

See application file for complete search history.

(56) References Cited

U.S. PATENT DOCUMENTS

| | | | | |
|---|---|---|---|---|
| 5,655,753 | A * | 8/1997 | Berges et al. | 254/134.3 SC |
| 6,983,714 | B2 * | 1/2006 | Dove et al. | 114/293 |
| 8,176,866 | B2 * | 5/2012 | Lenes et al. | 114/230.2 |
| 8,654,189 | B1 * | 2/2014 | Spangler et al. | 348/81 |
| 8,757,077 | B2 * | 6/2014 | Edelson et al. | 114/230.2 |
| 2014/0017013 | A1 * | 1/2014 | Ma | 405/195.1 |

OTHER PUBLICATIONS

Lofteoperasjoner under vane, 81 pages, Nov. 22-23, 2006.

* cited by examiner

*Primary Examiner* — Ajay Vasudeva
(74) *Attorney, Agent, or Firm* — Karen R. DiDomenicis

(57) ABSTRACT

Disclosed are platforms adapted to be mounted onto anchor handling vessels (AHVs) and AHVs useful for replacing a used wire rope segment or for installing a new wire rope segment in a mooring line which can be used for mooring a floating vessel such as a floating storage and offloading (FSO) vessel.

7 Claims, 18 Drawing Sheets

APPARATUS AND ANCHOR HANDLING VESSELS FOR INSTALLING OR REMOVING AND REPLACING A SEGMENT OF A MOORING LINE

FIELD

The present disclosure relates to apparatus for installing or removing and replacing a segment of a mooring line, such as used to moor floating storage and offloading vessels. The present disclosure further relates to an anchor handling vessel onto which such apparatus is mounted.

BACKGROUND

Floating storage and offloading (FSO) vessels keep station using a system of mooring lines terminating at anchoring means, such as suction piles. The mooring lines typically include multiple segments, including at least one chain segment at the anchor and, one chain segment at the FSO, and a wire rope segment there between. The wire rope is made up of multiple strands of steel and is subject to corrosion in a subsea environment over time. For instance, a wire rope having a diameter of about 4 inches may have a design life of about 7-10 years after which the wire rope must be decommissioned or removed. The entire mooring line can be replaced; however, this is extremely costly since the field production has to be shutdown to allow welding on the FSO. In order to replace the wire rope segment of the mooring line, the conventional way is to send divers down to seafloor to disconnect the old wire rope from the adjacent chain segments and connect a new wire rope to the adjacent chain segments. The divers perform the necessary subsea cuts and connections while on the seabed in poor visibility, and manually perform all related physical tasks including lifting. These are dangerous because of the weight and tension on the steel components. If weather turns severe, the divers may be trapped in the subsea environment until conditions are calmer that the boat could resume diving support.

It would be desirable to have a safer method to extend the life of the mooring line by replacing the old wire rope segment which would not require divers to perform operations subsea.

SUMMARY

In one aspect, a platform is provided adapted to be mounted onto an anchor handling vessel (AHV) for receiving a mooring line retrieved from the seabed. The platform includes a first end having a chain chute, a second end movable relative to the first and having a wire rope chute and having rollers mounted on the wire rope chute adapted to contact a mooring line segment passing over the wire rope chute, a chain stopper movable between a chain locking position and a released chain position, and a wire socket stopper movable between a wire rope locking position and a released wire rope position. The platform further includes positional control mechanisms for controlling the position of the first end relative to the second and, the position of the chain stopper relative to the chain chute and the position of the wire socket stopper relative to the wire rope chute.

In another aspect, a platform is provided adapted to be mounted onto an AHV for receiving a mooring line retrieved from the seabed. The platform includes a first end having a chain chute, a second end movable relative to the first, a chain stopper movable between a chain locking position and a released chain position, and a wire socket stopper movable between a wire rope locking position and a released wire rope position. The platform further includes positional control mechanisms for controlling the position of the first end relative to the second and, the position of the chain stopper relative to the chain chute and the position of the wire socket stopper relative to the wire rope chute. The platform further includes a curved deflector plate mounted adjacent the platform and adapted to direct a mooring line from the wire rope chute of the platform towards a reel located on the AHV.

In yet another aspect, an AHV is provided for removing and/or replacing a segment of a mooring line utilizing the methods and platforms disclosed herein.

DESCRIPTION OF THE DRAWINGS

These and other objects, features and advantages of the present invention will become better understood with reference to the following description, appended claims and accompanying drawings where:

DETAILED DESCRIPTION

A floating vessel can be moored by a mooring line connected to an anchor according to conventional practice. One end of the mooring line is commonly attached to the floating vessel, and the other end of the mooring line is attached to an anchor such as a pile driven into the seabed. The mooring line can be attached to the floating vessel using any convenient arrangement, e.g., at a turret at the bow of the floating vessel. The mooring line includes three segments, a first chain segment attached to the floating vessel, a wire rope segment attached to the first chain segment and a second chain segment attached to the wire rope segment and the anchor. The wire rope segment is substantially on the seabed. Over time, the wire rope segment is subject to corrosion and aging and must be replaced or decommissioned.

The present disclosure will describe methods and apparatus for replacing a used wire rope segment of a mooring line, as well as methods and apparatus for installing a new wire rope segment.

Figure 1A:
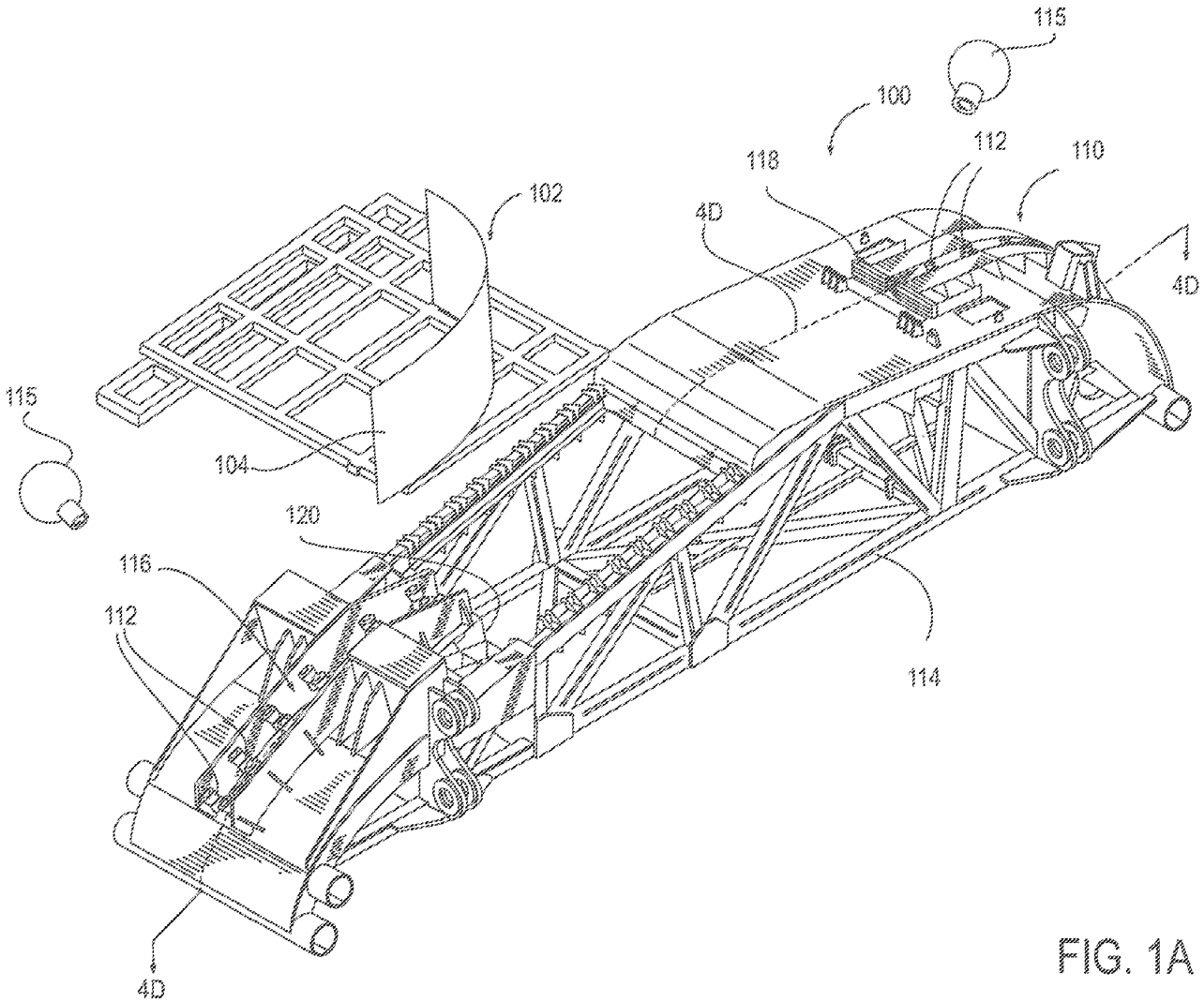
FIGS. 1A-1B are perspective views of a platform according to one embodiment.
Figure 1B:
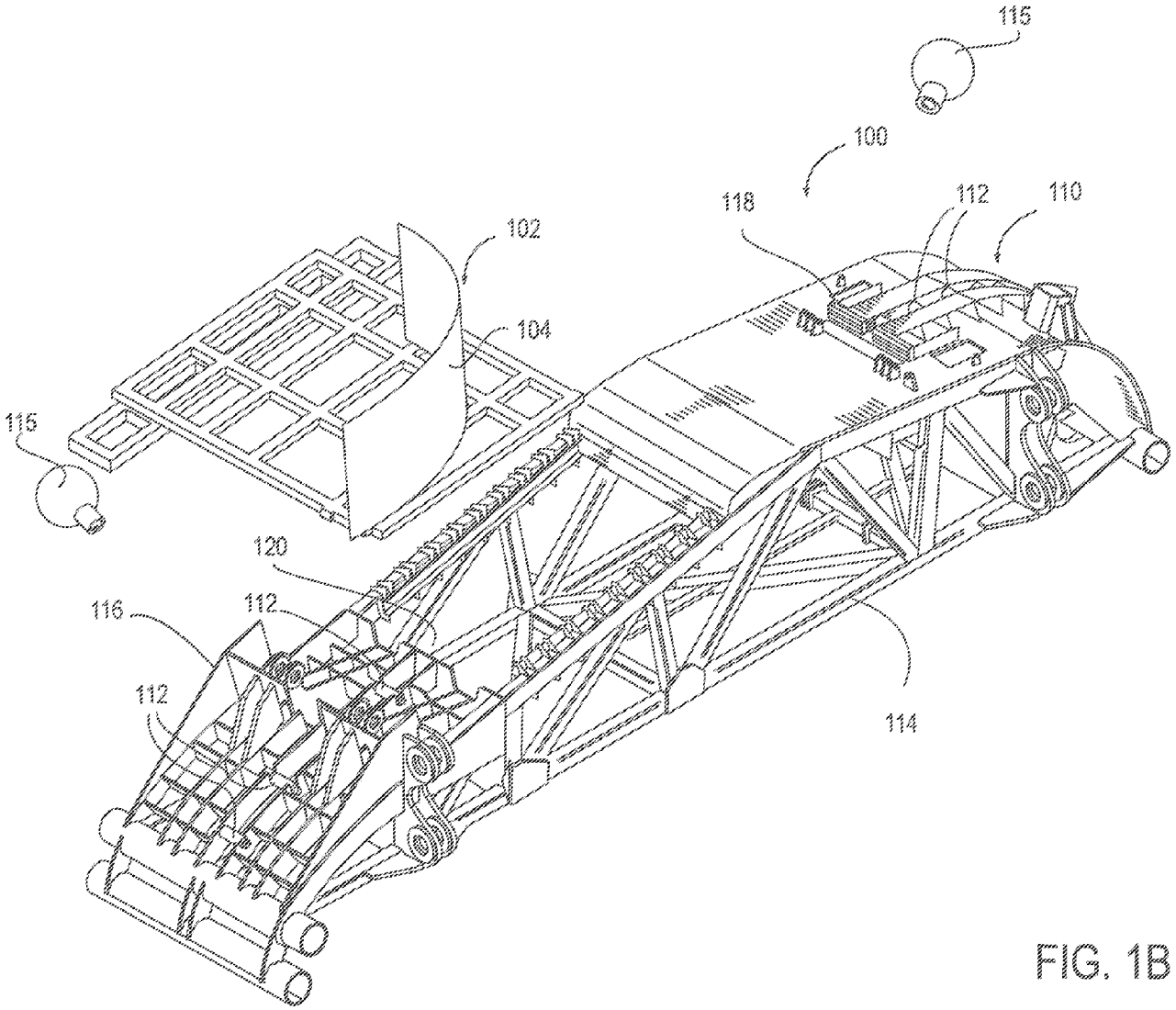

FIGS. 1A-1B are perspective views of embodiments of an apparatus also referred to as a platform 100 useful for carrying out the methods described herein. The platform 100 which can be formed of carbon steel is configured to support and receive a mooring line (not shown) along its length. The platform 100 includes a frame 114 and has a first end, also referred to as the chain end, having a chain chute 110 therein for supporting a length of chain hanging off the first end of the platform. The platform has a second end, also referred to as the wire rope end, which is movable relative to the first end having a wire rope chute 116 therein for supporting a length of wire rope hanging off the second end of the platform. In one embodiment, the wire rope chute 116 has rollers 112 mounted on the wire rope chute 116 adapted to contact a mooring line segment, e.g., a segment of wire rope, passing over the wire rope chute. FIG. 1A illustrates pairs of rollers 112 having a vertical axis of rotation, which the wire rope can pass between. FIG. 1B illustrates horizontally oriented rollers 112 which the wire rope can pass over. In either embodiment, the rollers 112 mounted in the wire rope chute 116 of the platform 100 serve to protect a mooring line segment e.g., a segment of wire rope, during the winding up of a mooring line segment from the seabed or the laydown, also referred to as the payout, of a mooring line segment on to the seabed.

A chain stopper 118 movable between a chain locking position and a released chain position is provided to enable locking the chain in a position securely on the platform 100. In the chain locking position, the chain stopper 118 protrudes from the surface of the chain chute 110 and engages a chain link. In the released chain position, the chain stopper 118 is receded below the surface of the chain chute. The position of the chain stopper relative to the surface of the chain chute is controlled by a control mechanism such as a hydraulic piston as indicated in FIG. 4D, FIG. 4F and FIG. 5A.

Similarly, a wire socket stopper 120 movable between a wire rope locking position and a released wire rope position is provided to enable locking the wire rope in a position securely on the platform 100. In a protruded locking position, the wire socket stopper 120 can engage a fixed element along the wire rope such as a connector also referred to as a union, e.g. a wire socket, at the end of a wire rope. The position of the wire socket stopper 120, either in the protruded locking position or the receded released position, is controlled by a control mechanism such as a hydraulic piston as indicated in FIG. 4D, FIG. 4F and FIG. 5A.

The platform 100 utilizes a positional control mechanism for controlling the position of the chain end relative to the wire rope end. The positional control mechanism can be any appropriate means as would be apparent to one skilled in the art, such as a hydraulic piston reference numeral 123 as indicated in FIG. 4G, in which case the stroke distance of the piston determines the range of separation between the chain end and the wire rope end. When the chain stopper 118 and the wire socket stopper 120 are engaged to lock a chain segment and a wire rope segment of a mooring line in position on the platform 100, the piston can be used to control the amount of tension in the mooring line. Hydraulic pistons if present can be connected to a hydraulic power unit on the AHV on which the platform 100 is mounted as would be apparent to one skilled in the art.

The rollers 112 on the wire rope chute protect the wire rope as it passes over the platform 100. This protects a new wire rope segment as it is being laid down from abrasion and damage caused by contact with sharp edges and the like. The rollers 112 also prevent the wire rope from kinking and bending excessively. In addition to protecting the wire rope, the rollers also facilitate smooth movement of the wire rope as a used wire rope segment is being retrieved from the seabed or a new wire rope segment is being laid down, and as the AHV is moving from one location to another.

In order to monitor the wire rope passing through the wire rope chute of the platform, the mooring chain passing through the chain chute of the platform, or the connecting and severing operations on the platform, one or more video cameras 115 may be mounted on the platform 100 or a nearby structure as would be apparent to one skilled in the art. The video camera can be part of a closed-circuit television system which can be monitored by persons remotely. This can reduce the need persons on the platform, thus enhancing the safety of operations. The video camera can also be used to monitor the lowering of a mooring line once a new wire rope has been installed.

Figure 2:
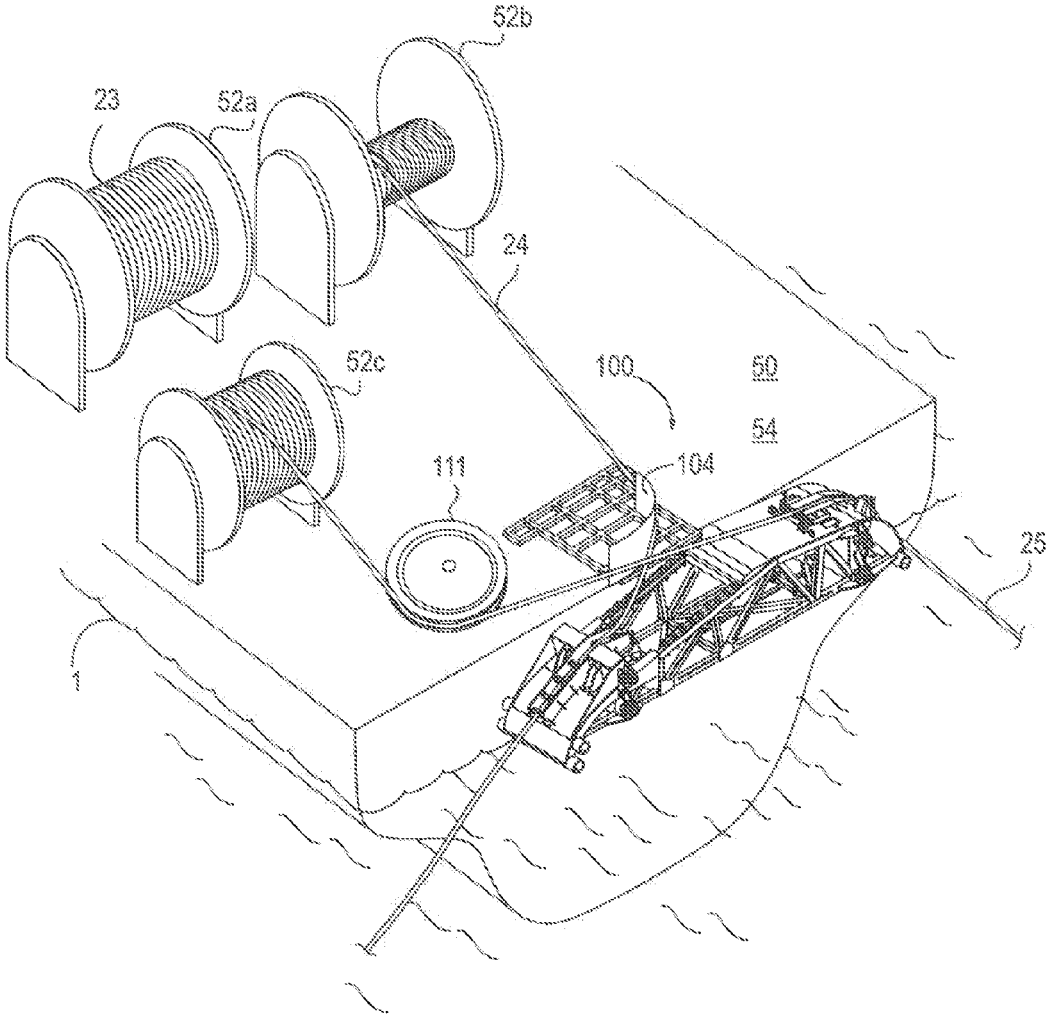
FIG. 2 illustrates an AHV according to one embodiment.

In one embodiment, a curved deflector plate 104 is mounted on a support 102 adjacent the platform 100. The deflector plate 104 can be used to direct or guide a used mooring line 24 from the wire rope chute 116 of the platform towards a used mooring line reel 52*b* located on the AHV 50 (as shown in FIG. 2), or to direct or guide a new mooring line 23 from a new mooring line reel 52*a* located on the AHV 50. The deflector plate 104 serves to change the direction of the line passing over it with a sufficient radius to protect the line, e.g., a new wire rope segment, and to prevent kinking and excessive bending. The diameter of the curved deflector plate 104 should be sufficiently large to prevent any excessive bending in the wire rope. For example, the diameter of the curved deflector plate 104 can be 20 times or more greater than the diameter of the wire rope.

FIG. 5A is an aerial view of platform 100 as mounted on the stern of AHV 50. An end sheave 111 can be mounted adjacent the platform at one or at both ends of the platform, to hold a wire rope, e.g. new wire rope segment 23, and a mooring chain, e.g. proximal mooring chain segment 21, guide the wire rope and chain. The position of the end sheave 111 can be controlled in multiple directions using any convenient positional control mechanism is would be apparent to one skilled in the art. For example, a hydraulic cylinder (not shown) can be used to control the outboard distance 97 of the end sheave 111, or the distance of the end sheave 111 to the AHV 50. The angle of the end sheave 111 with respect to the horizontal can also be adjusted by rotating end sheave 111 with respect to axis of rotation 99, so that the line coming from the end sheave 111 is properly aligned with the chain chute on the platform. Optionally, a second end sheave (not shown) can also be used on the AHV for guiding the mooring line (mooring chain) at the second end of the platform.

Figure 5A:
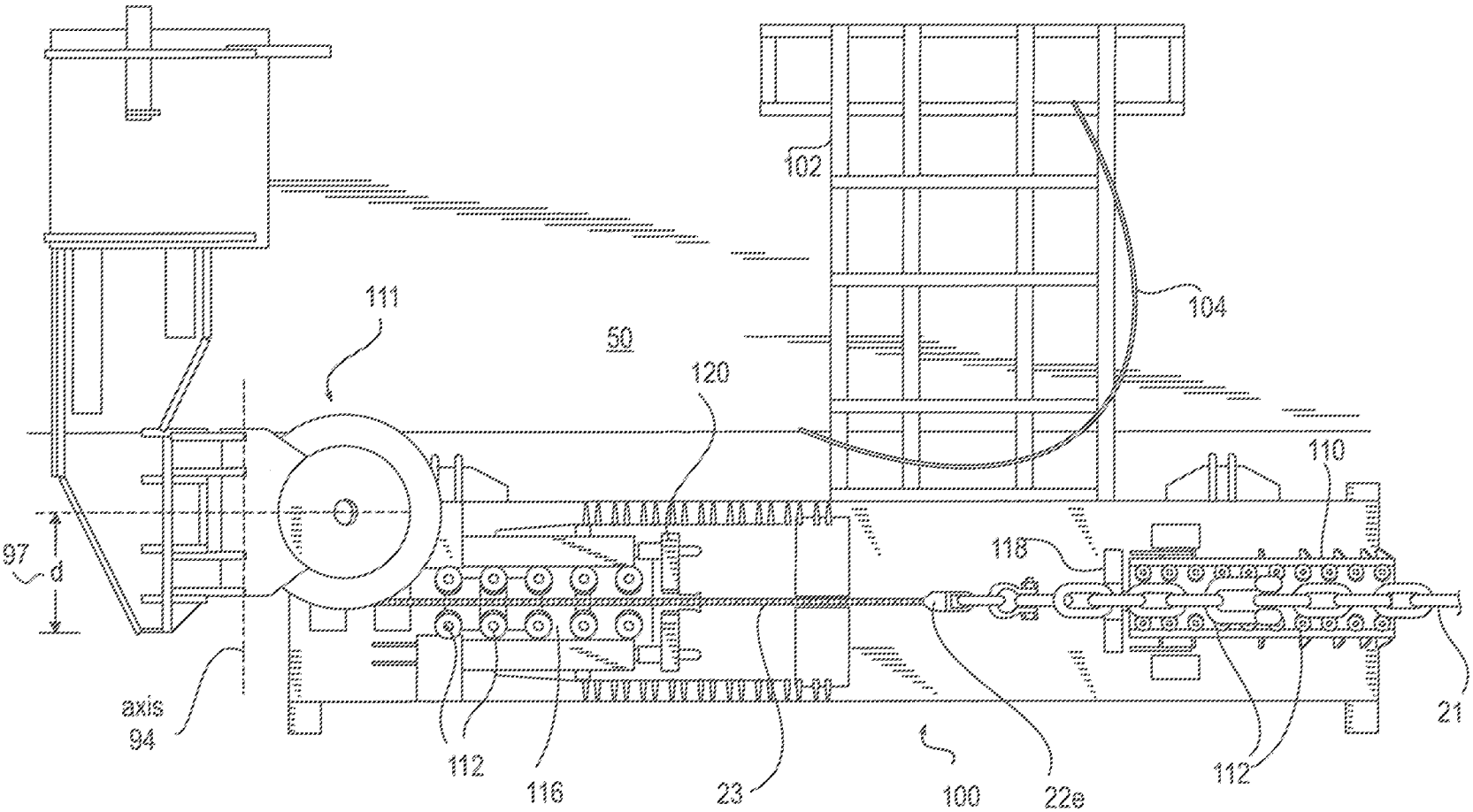
FIGS. 5A-5B are aerial views of a platform according to one embodiment.
Figure 5B:
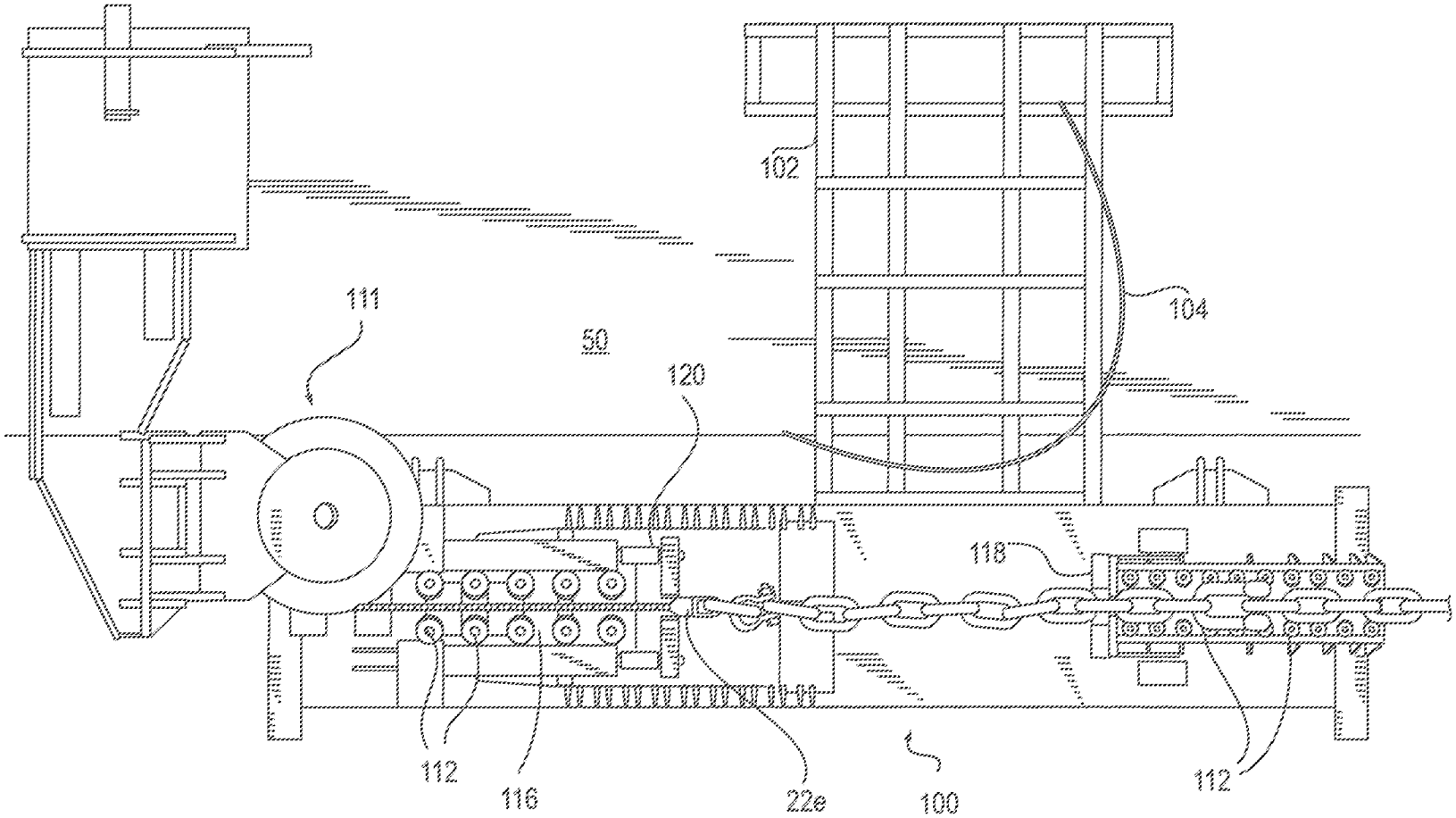

FIG. 5A illustrates a mooring line segment placed on the platform, including a portion of wire rope in the wire rope chute 116, and a portion of chain in the chain chute 110. As can be seen, the wire rope and the chain are in contact with rollers 112 in their respective chutes. Wire socket stopper 120 is engaged so that the wire rope is locked in place, and chain stopper 118 is engaged so that the chain is locked in place. FIG. 5B is an aerial view illustrating the platform 100 when the wire socket stopper 120 is moved towards the chain stopper 118, thereby placing slack in the portion of the mooring line between 120 and 118.

FIG. 2 illustrates an exemplary AHV 50 floating in water 1 with the platform 100 mounted thereon, useful for replacing and/or installing a wire rope segment of a mooring line. The platform 100 is advantageously mounted on the stern of the AHV 50.

The AHV 50 supports one or more reels 52*a*, 52*b* and 52*c* for storing and transporting new wire rope 23 to be installed, temporary working wire 25 to facilitate the disclosed methods and used wire rope 24 to be retrieved from the seabed, respectively.

Figure 4A:
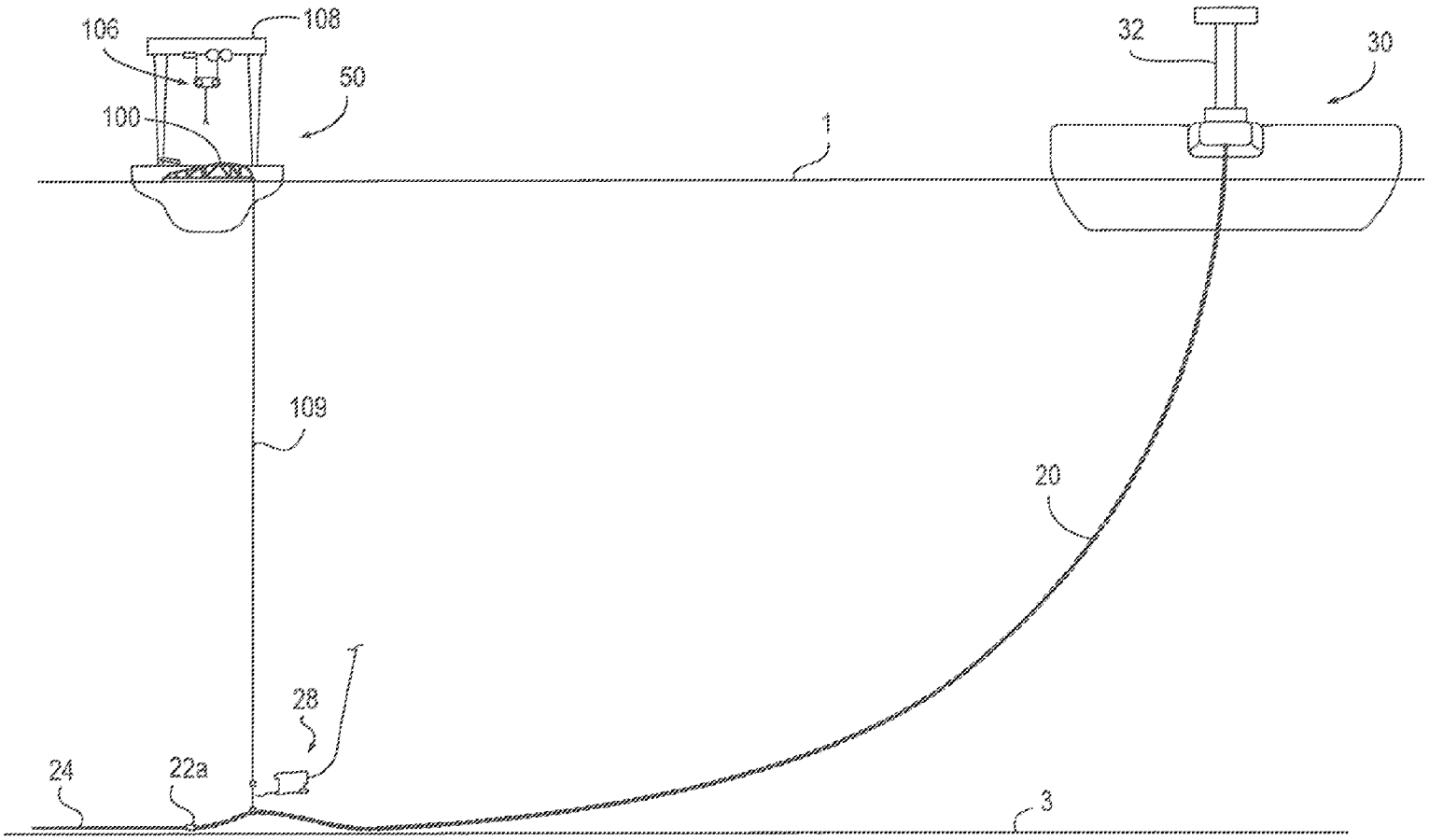
FIGS. 4A-4N illustrate method steps for replacing a mooring line segment according to one exemplary embodiment.

The AHV 50 can include an A-frame structure 108 (shown in FIG. 4A; for simplicity not shown in FIG. 2) mounted at the stern of the AHV as shown in FIG. 4A to support gantry 106. The gantry 106 also referred to herein as the lifting line, can include a block and tackle. The A-frame 108 can be detachable from the deck 54 of the AHV 50.

Figure 3A:
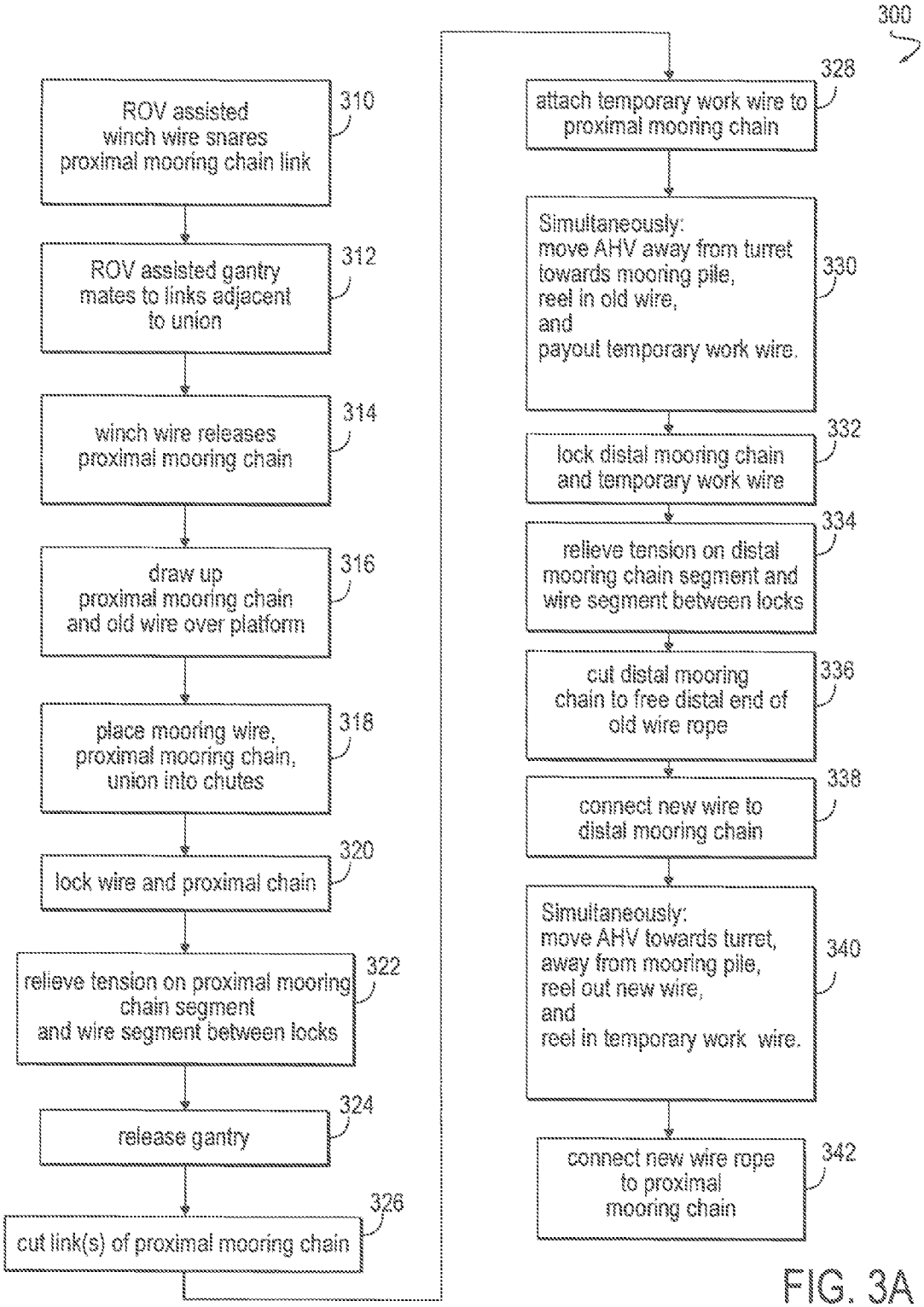
FIG. 3A is a flow chart of method steps for replacing a mooring line segment according to one embodiment.
Figure 3B:
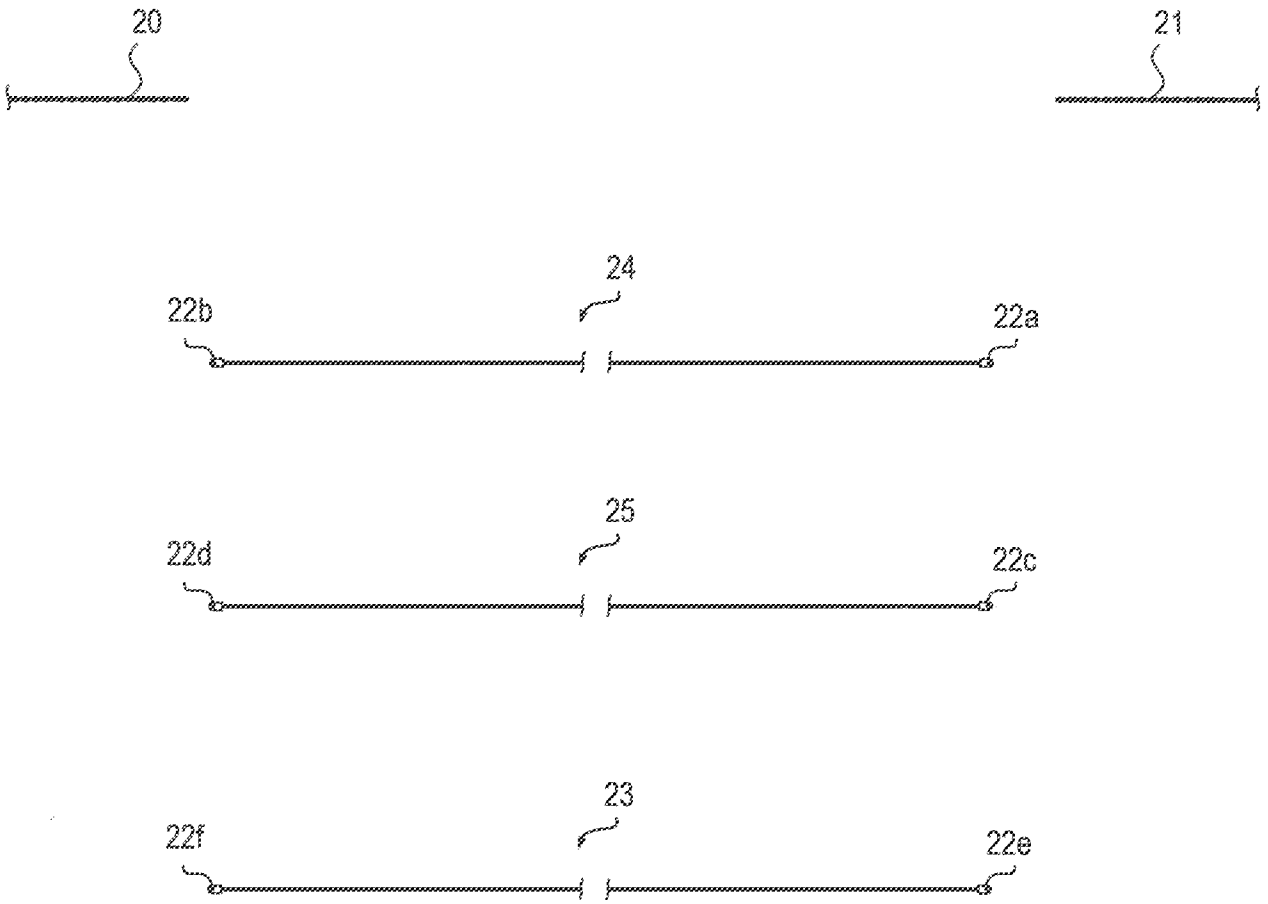
FIG. 3B illustrates various mooring chain and mooring wire combinations used in the methods and systems of the present disclosure.

FIG. 3A is a flowchart listing steps in a method 300 for replacing a used mooring line segment according to one embodiment. The AHV is initially positioned at a desired location above a first end, also referred to as the proximal end, of a mooring line segment to be removed. The mooring line segment to be removed can be a used wire rope segment 24 between a proximal mooring chain 20 and a distal mooring chain 21, as shown in FIG. 3B. The used wire rope segment 24 is also referred to herein as the old wire segment 24. Each end of the used wire rope segment 24 has a connector also referred to as a union, 22*a* and 22*b*, for securely connecting the wire rope segment 24 to the mooring chains 20, 21 on each end. The unions 22*a*-22*f* illustrated are for illustration purposes only. Any suitable connection means for securely connecting a wire rope segment to a mooring chain segment can be used. For example, shackles or H-links may be used as the unions, as would be apparent to one skilled in the art.

In one embodiment, in step 310, illustrated in FIG. 4A, a winch wire 109 which is secured on one end on the AHV 50 is attached to the proximal mooring chain 20 by snaring a mooring chain link, so that the mooring chain can be retrieved from the seabed 3. As illustrated, the proximal mooring chain 20 can be attached to a turret 32 on a FSO 30. The winch wire 109 is attached to the mooring line by a remotely operated vehicle 28.

Figure 4B:
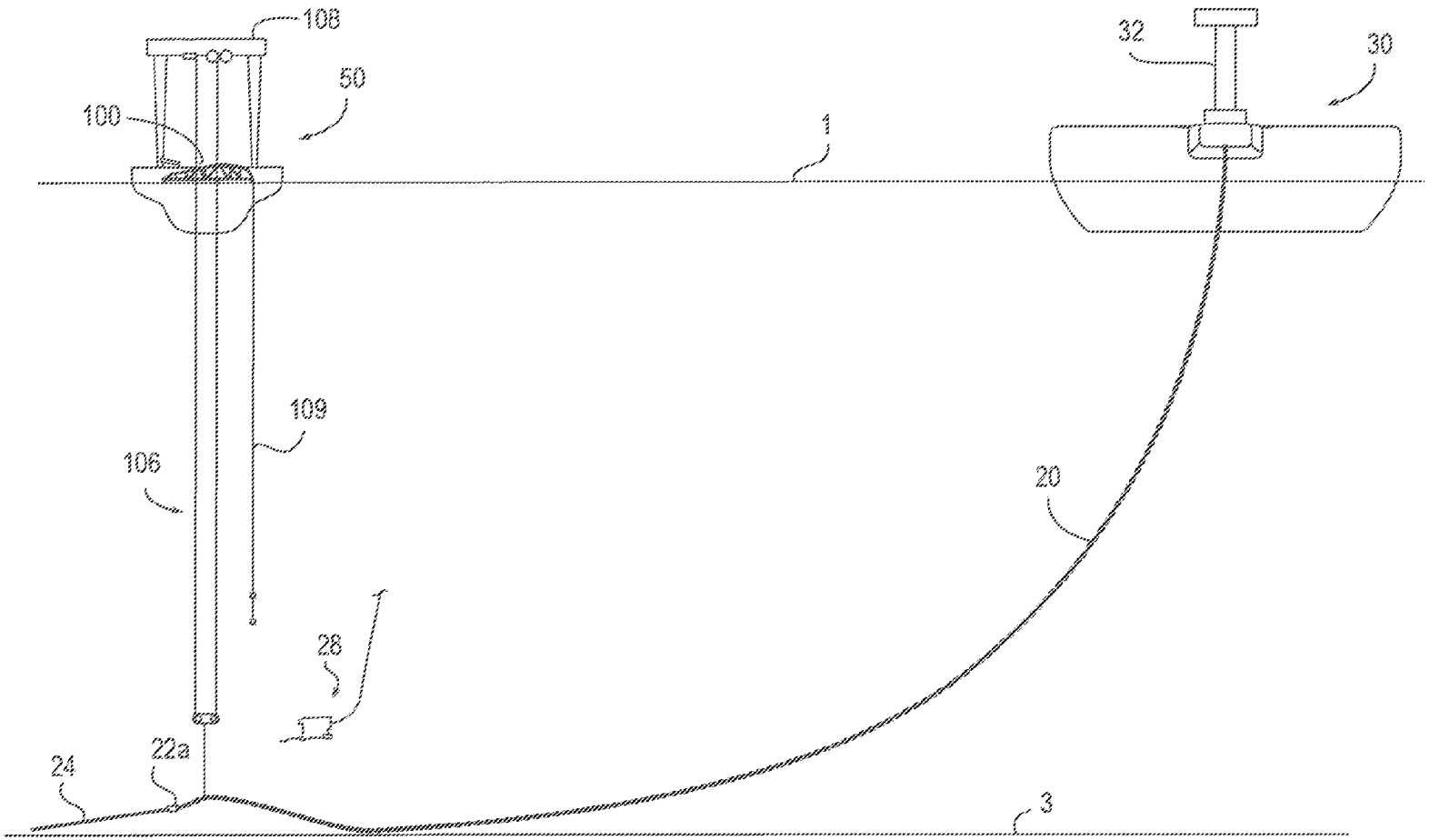

Again assisted by the remotely operated vehicle 28, in step 312, as illustrated in FIG. 4B, the gantry 106 suspended from the A-frame 108 is mated to chain links of mooring chain 20. Note, any other suitable crane and rigging can be used as would be apparent to one skilled in the art. The winch wire 109 then releases the mooring chain 20. As illustrated in FIG. 4B, the mooring chain 20 is then lifted from the seabed 3.

Figure 4C:
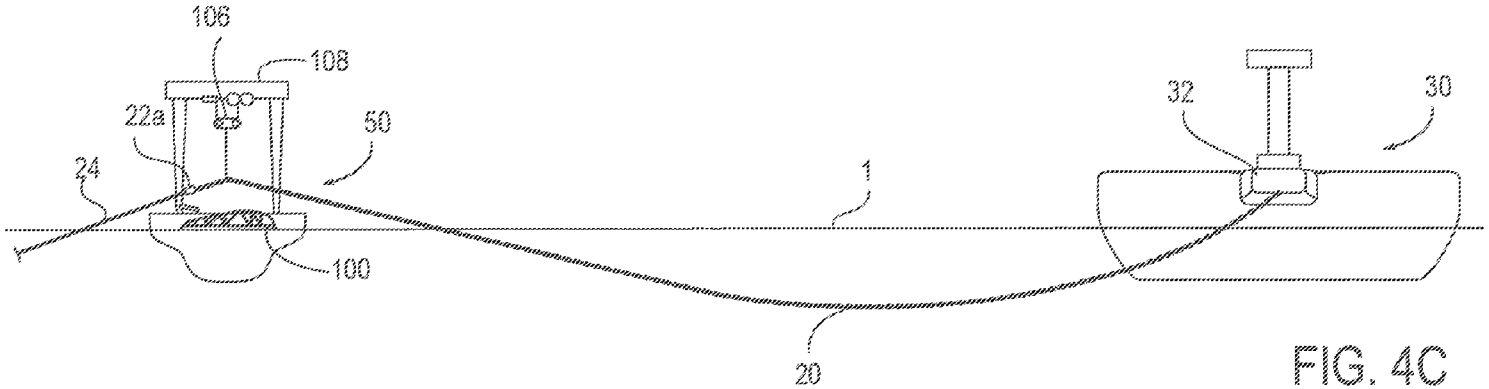
Figure 4D:
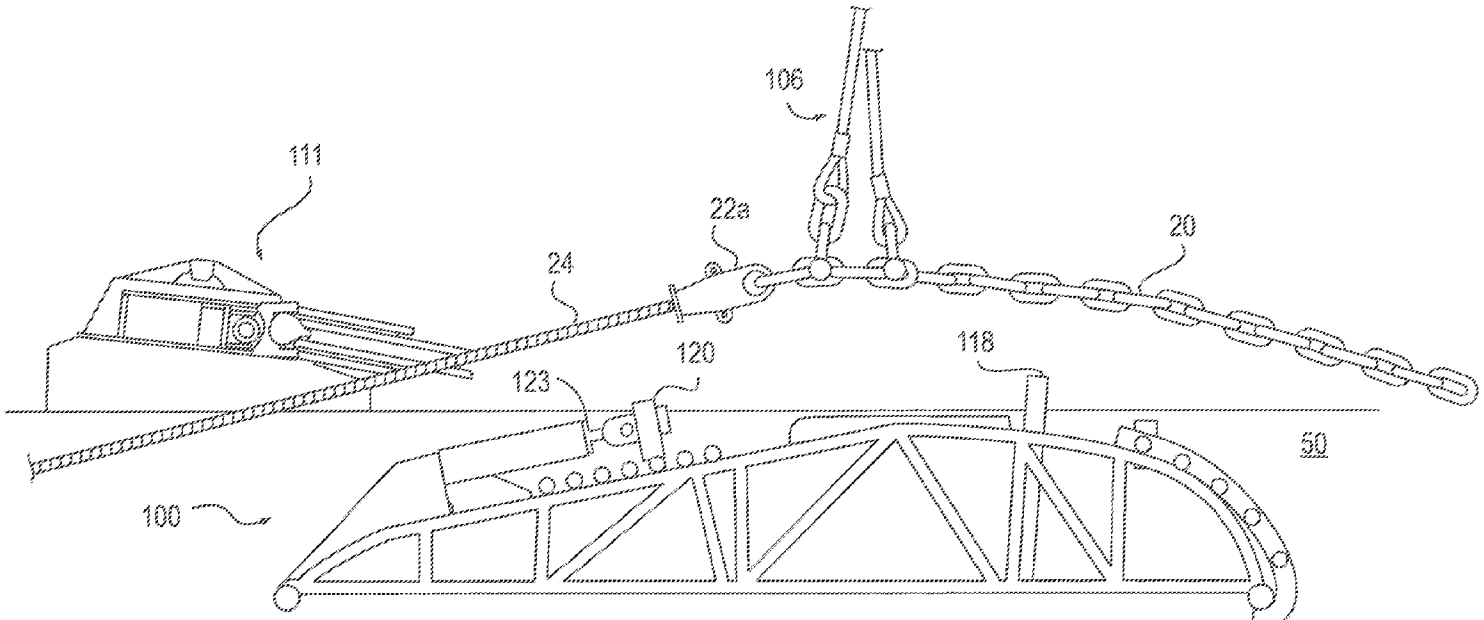

Step 316 is illustrated in FIGS. 4C and 4D (including a cutaway view of platform 100). The mooring line at the juncture of the mooring chain 20 and the old wire rope 24 is lifted up over the platform 100. The union 22*a* is at the juncture of the mooring chain 20 and the old wire rope 24.

Figure 4E:
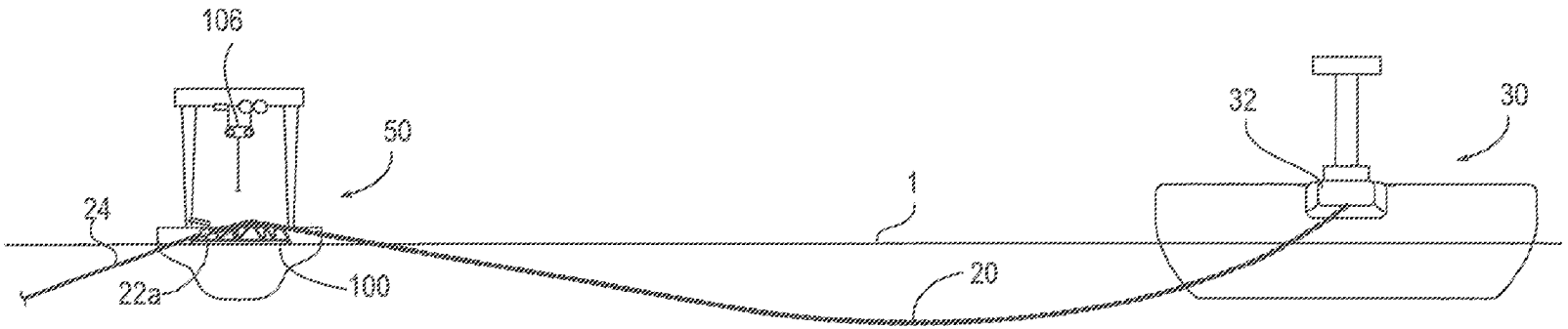
Figure 4F:
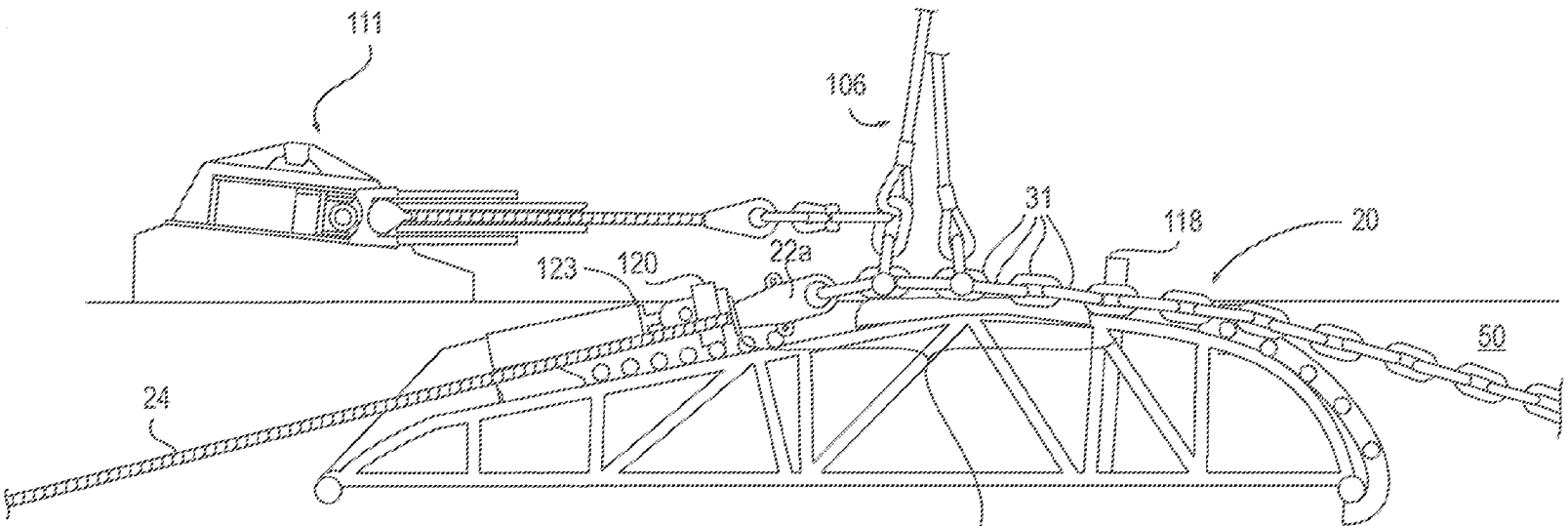
Figure 4G:
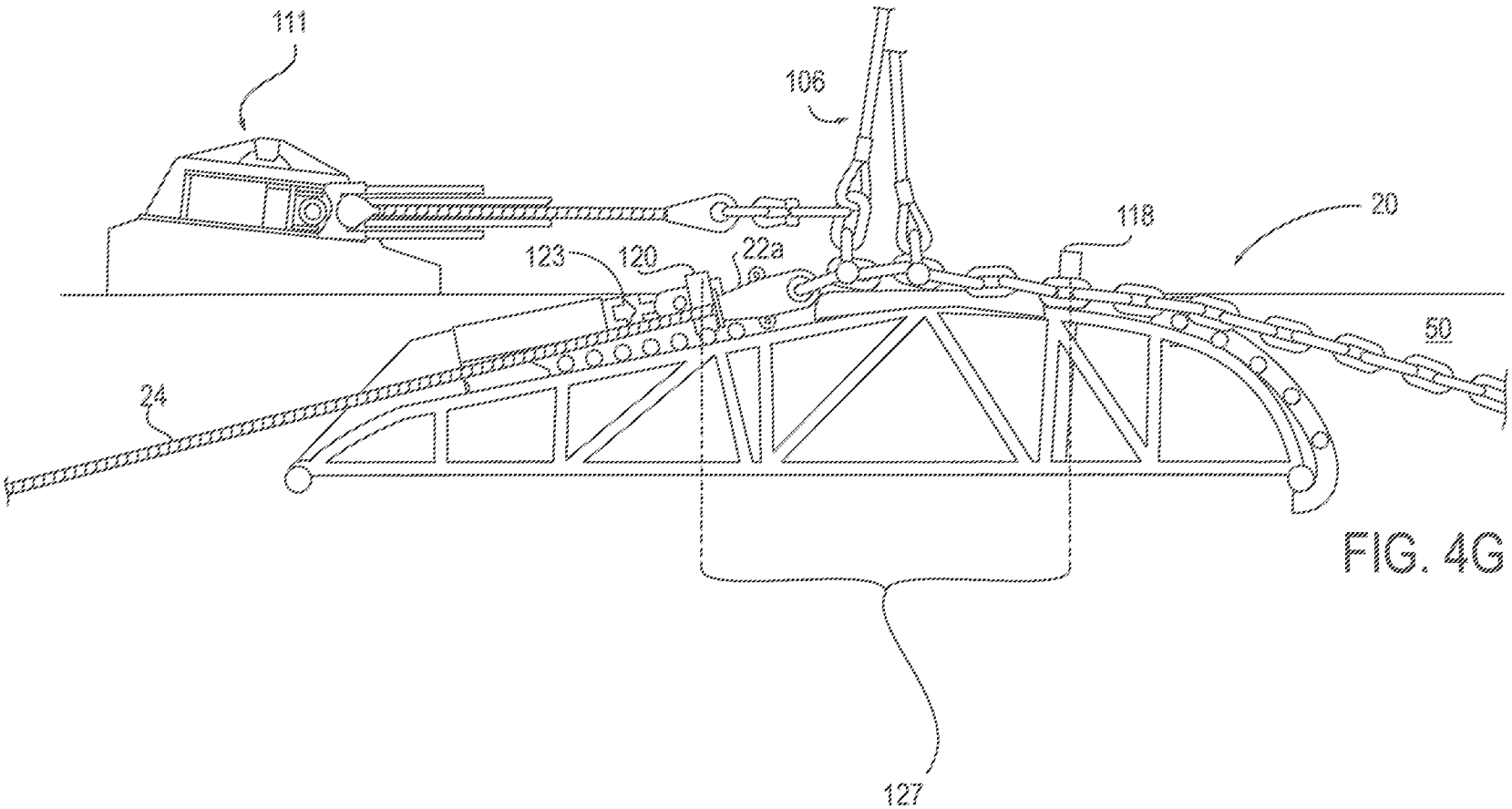

The mooring line is then placed on the platform 100 (step 318), as illustrated in FIGS. 4E and 4F. FIG. 4F includes a cutaway view of platform 100, showing the used wire rope 24 placed in the wire rope chute, and the proximal mooring chain 20 placed in the chain chute. In step 320, the old wire rope 24 and proximal mooring chain 20 are locked securely in place in their respective chutes. The old wire rope 24 is locked in place by engaging the wire socket stopper 120. The mooring chain 20 is locked in place by engaging the chain stopper 118. FIG. 4F illustrates one embodiment for locking the wire rope and chain, although other locking means could be used as would be apparent to one skilled in the art.

As shown in FIG. 4F, an end sheave 111 mounted on the deck of the AHV 50 can be used to hold a guide wire which can be attached to gantry 106 for holding the position and guiding the placement of the mooring line on the platform 100. The combined proximal mooring chain segment, including chain links 31, and wire rope segment, including union 22*a*, between the chain stopper 118 and the wire socket stopper 120 is referred to as the combined mooring line segment 127. As initially placed and locked on the platform, if the line is taut, the tension in the combined mooring line segment 127 may be too high for safely cutting the combined mooring line segment 127. The tension in the combined mooring line segment 127 is relieved in step 322 by moving the wire socket stopper 120 and/or the chain stopper 118 relative to one another in order to decrease the distance there between. Slack is introduced into segment 127, as can be seen in FIG. 4G. In the embodiment shown, wire socket stopper 120 is moved towards chain stopper 118 using hydraulic piston 123. At this point, the gantry 106 can be released (step 324).

Figure 4H:
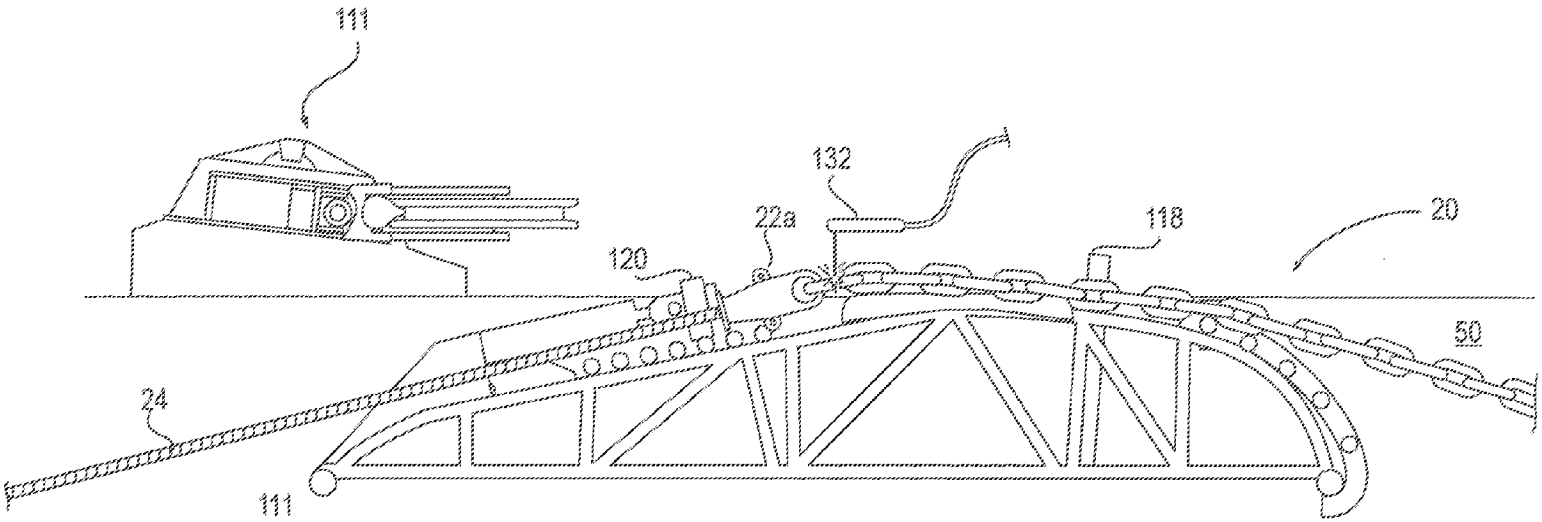

As shown in FIG. 4H, a cutting mechanism 132 such as an oxyacetylene torch can be used to cut one or more links of the proximal mooring chain 20 (step 326), thus forming a proximal mooring chain cut end, also referred to as a first mooring line cut end, and a first segment cut end. The first mooring line cut end can be a chain link. The first segment cut end can be union 22*a* at the end of used wire rope 24. Any other suitable cutting mechanism can be used as well.

Figure 4I:
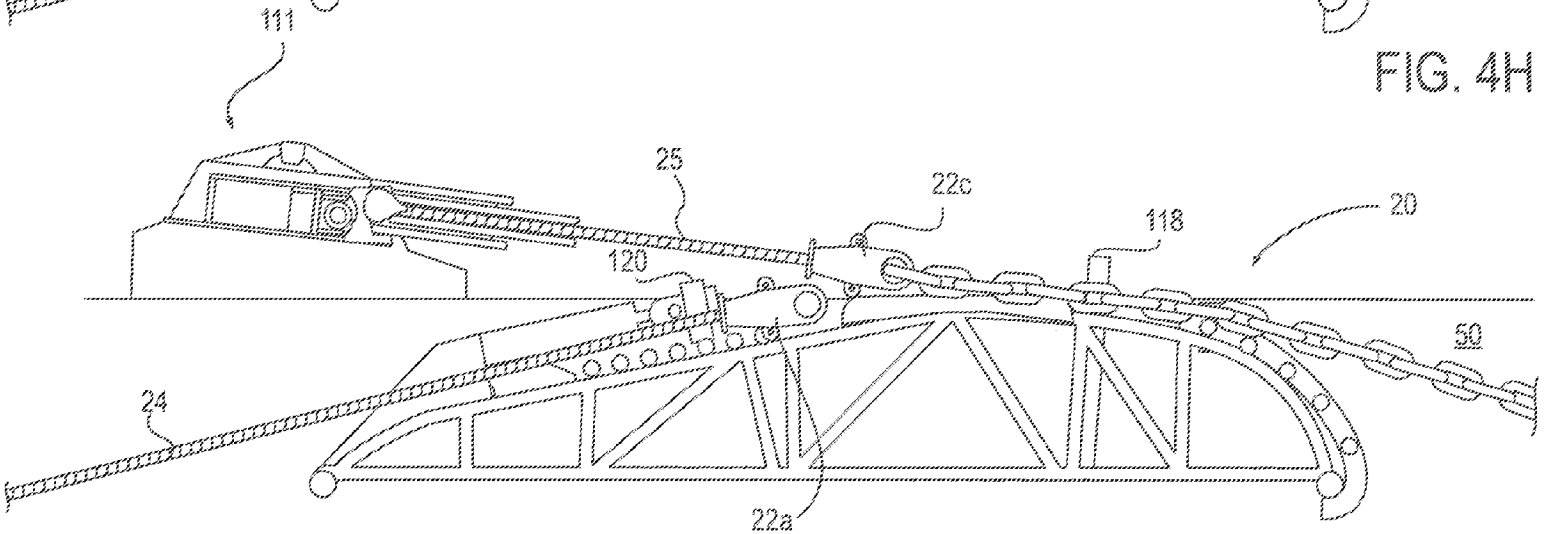

In one embodiment, as shown in FIG. 4I, a temporary work wire 25 is attached to the proximal mooring chain 20 on the platform 100 (step 328). The temporary work wire 25 can be unwound from a temporary work wire reel located on the deck of AHV 50, and guided through end sheave 111 which can hold the temporary work wire 25 in place while the attachment is made to the terminal chain-link using union 22*c*.

Figure 4J:
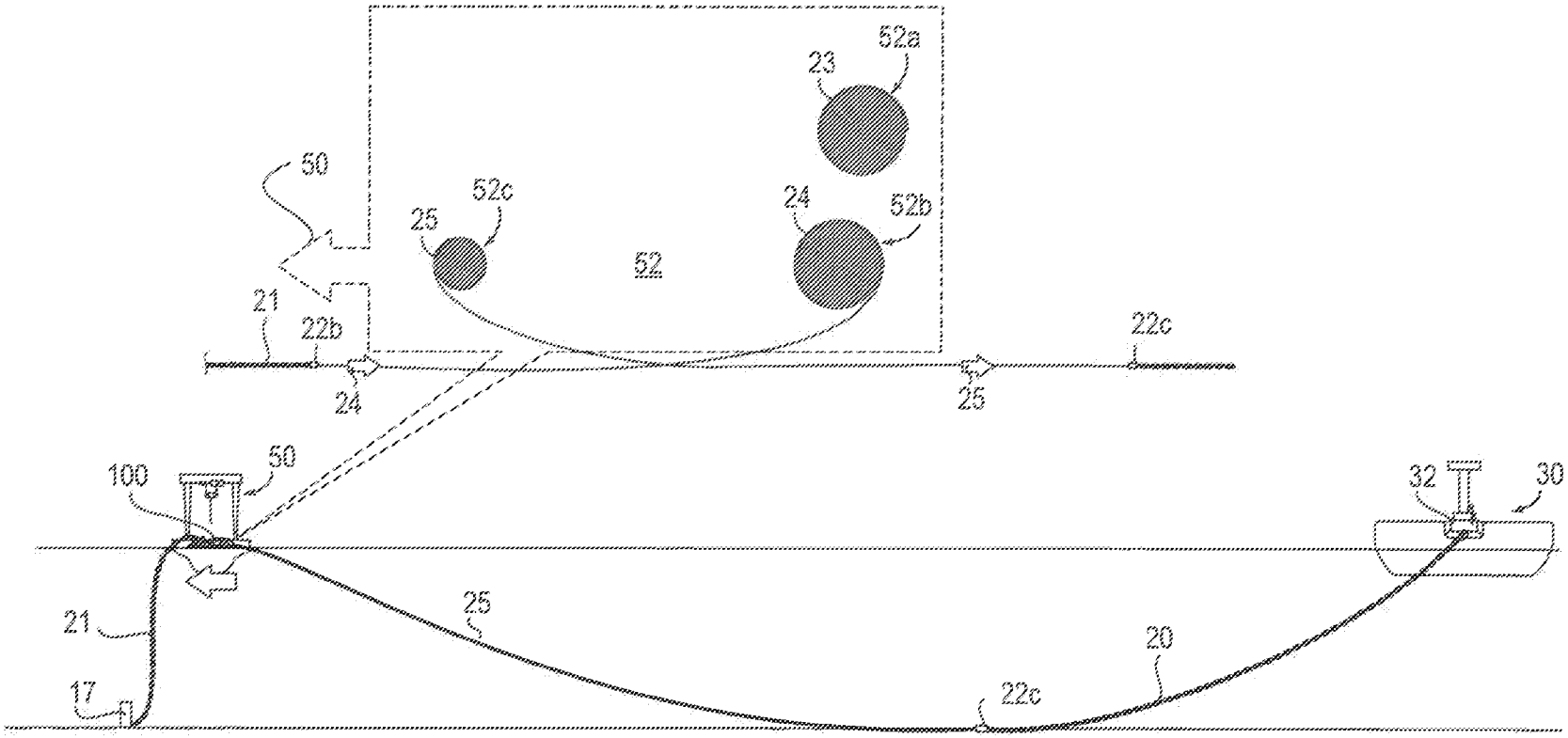

In step 330, as illustrated in FIG. 4J, the AHV 50 is navigated through the water away from the turret 32 of the FSO 30 and towards the mooring pile 17 to a second location at a second end of the old wire rope segment 24, at the juncture of the old wire rope segment 24 and the distal mooring chain 21. As the AHV 50 moves from the first location to the second location, the old wire rope segment 24 is wound onto a used wire rope reel 52*b* on the deck of the AHV 50 and the temporary work wire 25 is paid out or laid down from the temporary work wire reel 52*c* onto the seabed 3. A full new wire rope reel 52*a* is also on board the deck of the AHV 50.

In one embodiment, as the old wire rope 24 is taken up and wound onto the used wire rope reel 52*b*, the old wire rope 24 is passed over the curved deflector plate 104 to assist in winding up the old wire rope 24. Optionally, the curved deflector plate 104 includes guides (not shown) over which the wire rope can pass.

In one embodiment, as the old wire rope 24 is taken up and wound onto the used wire rope reel 52*b*, the old wire rope 24 is passed over rollers 112 in the wire rope chute 116 to protect and facilitate the winding up of the old wire rope 24.

At the second location, a combined mooring line segment including a portion of distal mooring chain 21, temporary work wire 25 and union 22*d* is positioned on platform 100 with the chain 21 in the chain chute 110 and the temporary work wire 25 in the wire rope chute 116. The distal mooring chain 21 is locked in place using the chain stopper 118, and the temporary working wire 25 is locked in place using the wire socket stopper 120 (step 332). The tension in the combined mooring line segment including the portion of distal mooring chain 21, temporary work wire 25 and union 22*d* is relieved in step 334 as in step 322 by moving the wire socket stopper 120 and/or the chain stopper 118 relative to one another in order to decrease the distance there between.

Figure 4K:
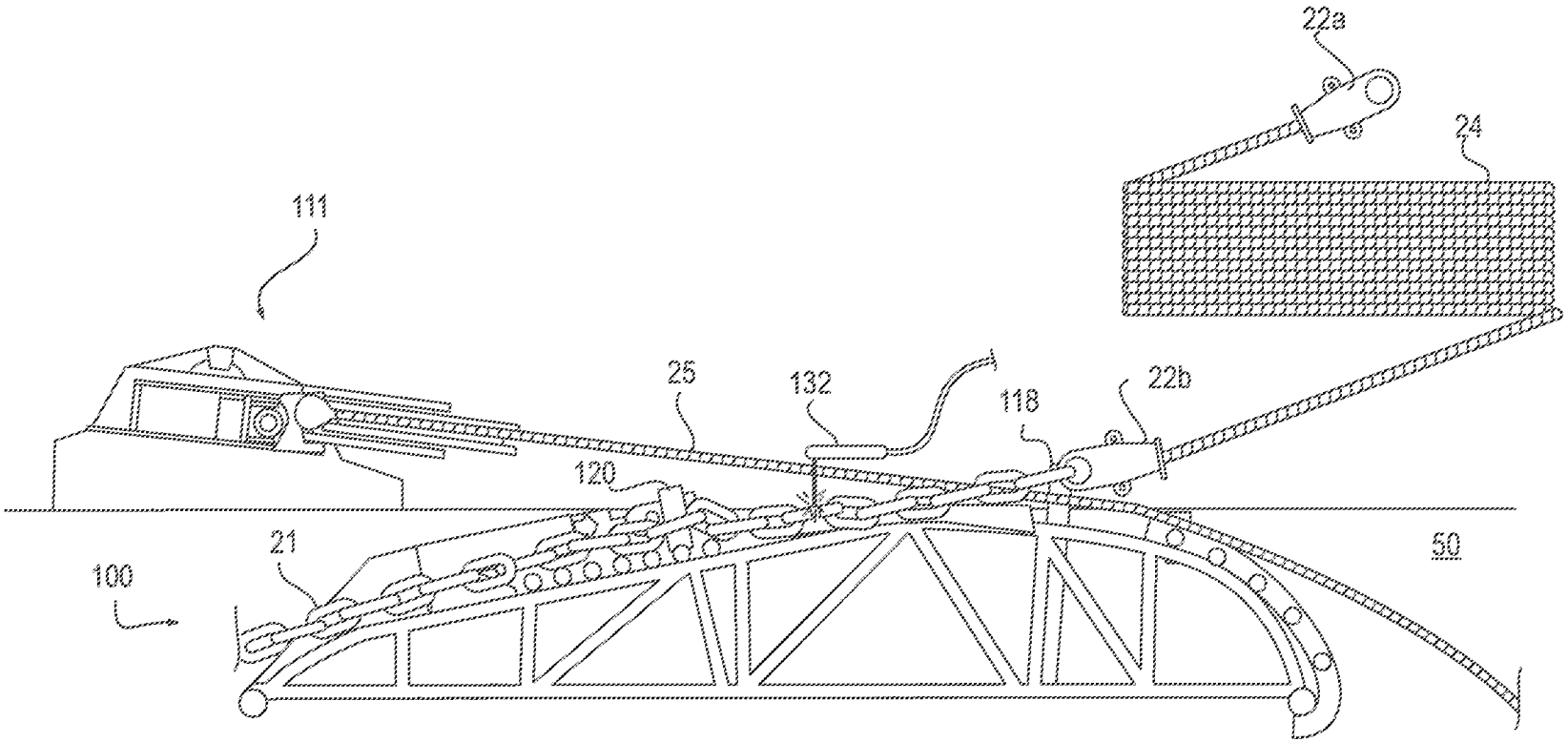

In step 336, as shown in FIG. 4K, one or more links of the distal mooring chain 21 are cut to form a distal mooring chain cut end, also referred to as a second mooring line cut end, and a second segment cut end. The second mooring line cut end can be a chain link. The second segment cut end can be union 22*b* at the end of used wire rope 24. At this point, used wire rope 24 is freed completely from the mooring line, and the end of used wire rope 24 can be completely wound onto the used wire rope reel 52 on the AHV 50.

Figure 4L:
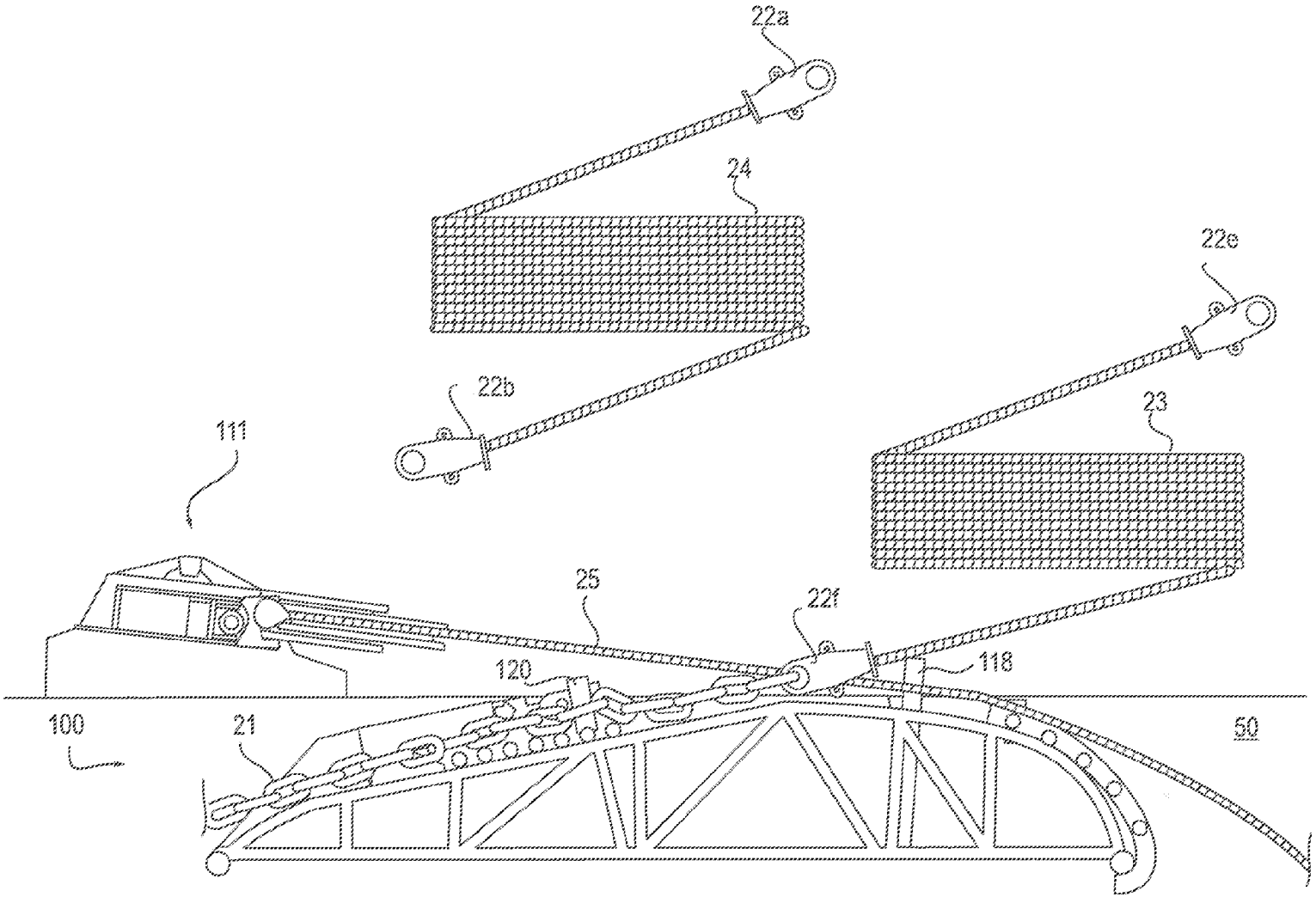

In step 336, as shown in FIG. 4L, one end of the new wire rope 23 wound on a new wire rope reel 52 is connected to the distal mooring chain 21 on the platform 100. The connection is made by way of union 22*f*. As shown in FIG. 4L, end sheave 111 holds the temporary working wire 25 during this step.

Figure 4M:
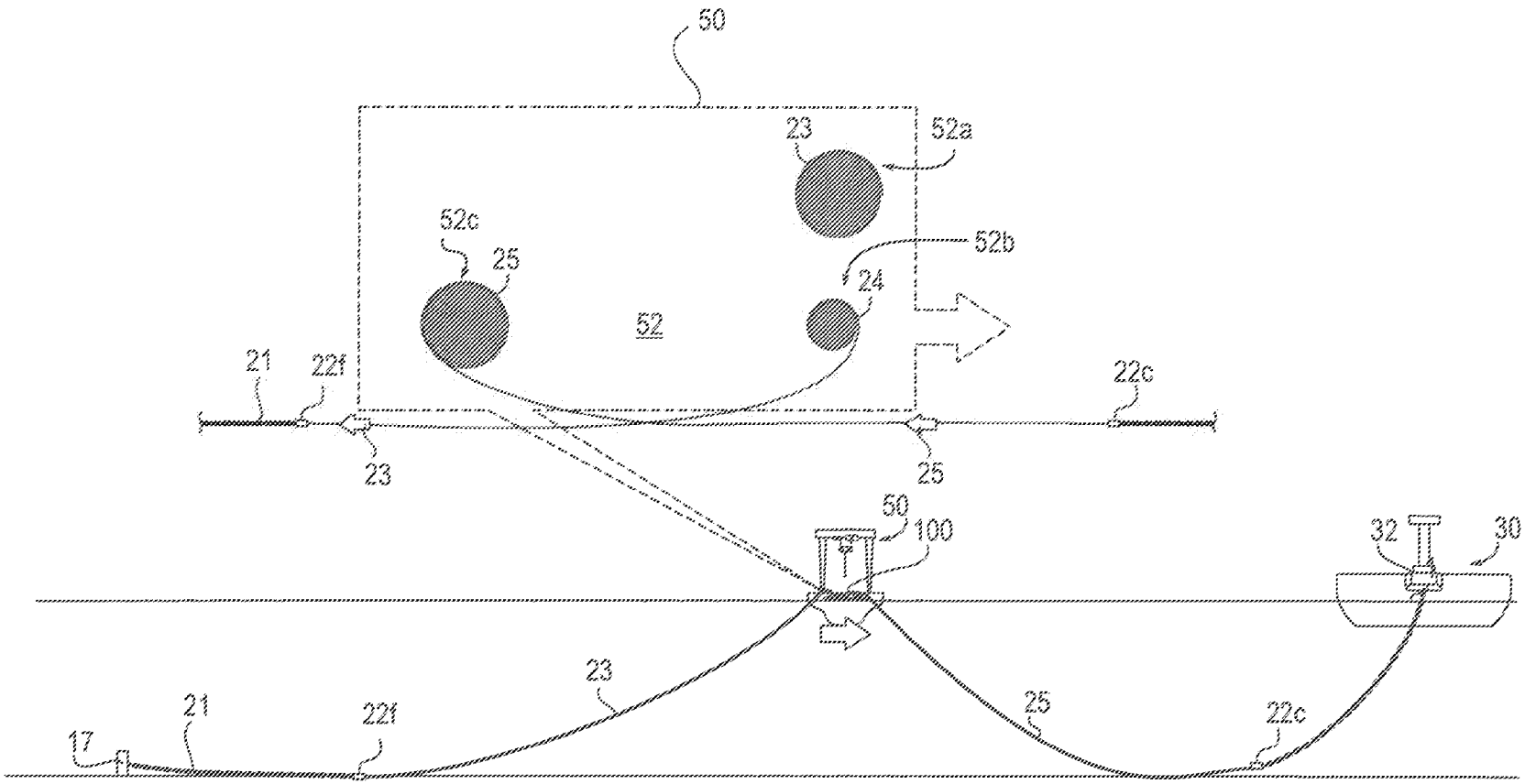

In step 340, as illustrated in FIG. 4M, the AHV 50 is navigated through the water away from the mooring pile 17, returning towards the turret 32 of the FSO 30 to the first location at a first end of the temporary working wire 25, at the juncture of the temporary working wire 25 and the proximal mooring chain 20. As the AHV 50 moves from the second location to the first location, the temporary working wire 25 is wound onto a temporary working wire reel 52*c* on the deck of the AHV 50 and the new wire rope 23 is paid out or laid down from the new wire rope reel 52*a* onto the seabed 3. At this point, used wire rope reel 52*b* is full with used wire rope 24.

In one embodiment, as the new wire rope 23 is unwound from the new wire rope reel 52*a*, it is passed over the curved deflector plate 104 to assist in unwinding the new wire rope 23. Optionally, the curved deflector plate 104 includes guides (not shown) over which the wire rope can pass.

In one embodiment, as the new wire rope 23 is unwound from the new wire rope reel 52*a*, it passes over rollers 112 in the wire rope chute 116 to protect and facilitate the winding up of the new wire rope 23.

At the first location, a combined mooring line segment including a portion of temporary working wire 25, proximal mooring chain 20 and union 22*c* (previously connected in step 328) is positioned on platform 100 with the chain 20 in the chain chute 110 and the temporary working wire 25 in the wire rope chute 116. The proximal mooring chain 20 is locked in place using the chain stopper 118, and the temporary working wire 25 is locked in place using the wire socket stopper 120. The tension in the combined mooring line segment is relieved again by moving the wire socket stopper 120 and/or the chain stopper 118 relative to one another in order to decrease the distance there between.

One or more links of the proximal mooring chain 20 are cut to form a proximal mooring chain cut end and a temporary working wire segment cut end. The temporary working wire segment cut end can be union 22*c*. At this point, temporary working wire 23 is freed completely from the mooring line, and the end of temporary working wire 23 can be completely wound onto the temporary working wire reel 52 on the AHV 50.

In step 342, the new wire rope 23 is connected to the proximal mooring chain 20 on the platform 100. The connection is made by way of union 22*e*. At this point, the old wire rope segment 24 of the mooring line has been replaced with the new wire rope segment 23. To achieve a desired tension in the mooring line, lengths of mooring line, e.g., chain links, can be added or removed.

Figure 4N:
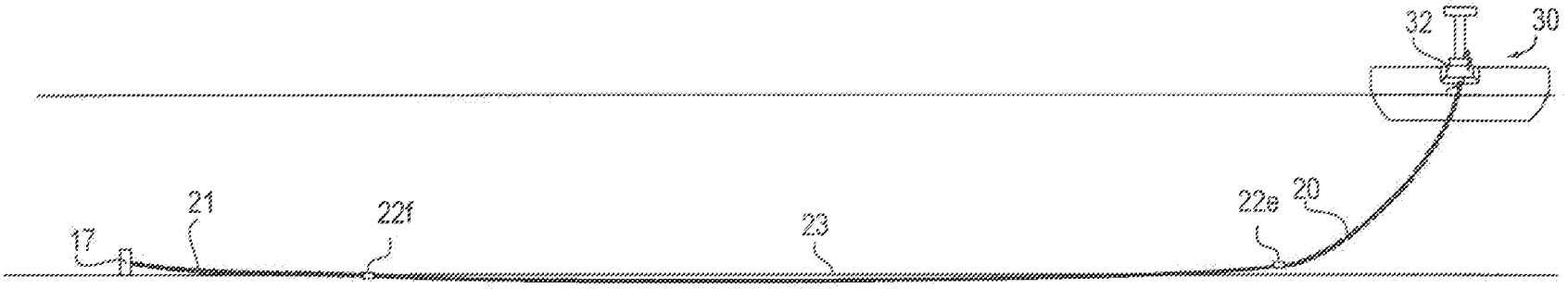

The new wire rope is then released from the wire rope chute 116 and the proximal mooring chain 20 is released from the chain chute 110, and the gantry 106 is attached to the mooring line. Using the gantry 106, the mooring line can be lifted above the platform 100, and lowered to the seabed 3. The ROV 28 can assist with disconnecting the gantry 106 from the mooring line. FIG. 4N illustrates the resulting mooring line including the new wire rope segment 23 on the seabed 3.

Although in the process embodiment 300 described above, the proximal mooring chain 20 is described and illustrated as the mooring chain segment closest to the FSO 30 and the distal mooring chain 21 is described and illustrated as the mooring chain segment closest to the pile 17, it should be understood that the proximal and distal mooring chains could be reversed, in which case the replacement of the old wire rope segment 24 would begin at the end of the old wire rope segment closest to the pile 17.

In another embodiment, a process is provided for installing a new mooring line where there was not previously an existing mooring line. In this embodiment, one end of a proximal mooring chain 20 can be attached to an FSO 30, e.g. at the turret 32 of an FSO, The other end can be secured in the chain chute 110 of the platform 100 and locked in place using the chain stopper 118. An end of a new wire rope 23 wound on a new wire rope reel 52 on the AHV 50 can be secured in the wire rope chute 112 and locked in place using the wire socket stopper 120. The end of the new wire rope 23 can be attached to the proximal mooring chain 20 on the platform 100 using a union 22*e*.

The AHV 50 can then be navigated through the water away from the FSO and towards the intended anchor location (pile 17) while the new wire rope 23 is laid down onto the seabed 3. As described before, in one embodiment, as the new wire rope 23 is unwound from the new wire rope reel 52*a*, the new wire rope 23 passes over a curved deflector plates 104 having optional guides thereon. As described before, in one embodiment, as the new wire rope 23 is unwound from the new wire rope reel 52*a*, the new wire rope 23 passes over rollers within the wire rope chute 112. At the distal end of the new wire rope segment 23, the wire rope is secured in the wire rope chute 112, and the distal mooring chain 21 is placed in the chain chute 110 and secured with the chain stopper 118. The distal end of the new wire rope segment is connected to the distal mooring chain 21 using a union 22*f*. The mooring line can then be lifted by the gantry 106 and lowered to the seabed 3. The distal end of the distal mooring chain 21 can then be attached to pile 17, thus completing the installation of the mooring line anchoring the FSO 30.

Where permitted, all publications, patents and patent applications cited in this application are herein incorporated by reference in their entirety, to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description, those skilled in the art will perceive improvements, changes and modifications, which are intended to be covered by the appended claims.

What is claimed is:

1. A platform mounted onto an anchor handling vessel above a water line of the vessel for receiving a mooring line retrieved from the seabed, the platform comprising:

a. a first end having a chain chute for supporting a chain portion of the mooring line;

b. a second end movable relative to the first end for adjusting tension in the mooring line, the platform further comprising a wire rope chute and having rollers mounted on the wire rope chute adapted to contact and protect a mooring line segment passing over the wire rope chute;

c. a positional control mechanism comprising a first hydraulic mechanism for adjusting longitudinal distance between the first end and the second end;

d. a chain stopper movable between a chain locking position protruding above an upper surface of the chain chute and a released chain position receded below the upper surface of the chain chute;

e. a chain stopper control mechanism comprising a second hydraulic mechanism for controlling the position of the chain stopper relative to the chain chute to lock and unlock movement of the chain portion of the mooring line segment relative to the platform;

f. a wire socket stopper movable between a wire rope locking position and a released wire rope position;

g. a wire socket stopper control mechanism comprising a third hydraulic mechanism for controlling the position of the wire socket stopper relative to the wire rope chute to lock and unlock movement of a wire portion of the mooring line segment relative to the platform; and h. a curved deflector plate mounted adjacent the platform and adapted to guide the mooring line between the wire rope chute of the platform and a reel located on the anchor handling vessel.

2. The platform of claim 1, further comprising a video camera attached to the platform capable of monitoring the mooring line passing over the platform.

3. The platform of claim 1, wherein the curved deflector plate has a diameter at least 20 times greater than a diameter of the wire rope.

4. An anchor handling vessel useful for removing, replacing and/or installing a mooring line segment located on a seabed, comprising:

a. an anchor handling vessel having a bow and stern;

b. the platform of claim 1 attached to the stern of the anchor handling vessel;

c. a first reel on the anchor handling vessel for storing a used mooring line segment to be retrieved from the seabed;

d. a second reel on the anchor handling vessel for storing a new mooring line segment to be installed on the seabed;

e. a third reel on the anchor handling vessel for storing a temporary work wire; and f. an end sheave mounted on the anchor handling vessel adjacent the platform for holding the new and used mooring line segments and the temporary work wire and for guiding the used mooring line segment, the new mooring line segment and the temporary work wire between the first, second and third reel, respectively, and the wire rope chute of the platform;

wherein the curved deflector plate guides the used mooring line segment from the wire rope chute to the first reel and guides the new mooring line segment from the second reel to the wire rope chute.

5. The anchor handling vessel of claim 4, further comprising a video camera attached to the anchor handling vessel capable of monitoring a mooring line passing over the platform.

6. The anchor handling vessel of claim 4, wherein the curved deflector plate has a diameter at least 20 times greater than a diameter of the wire rope.

7. The anchor handling vessel of claim 4, wherein the end sheave is adjustable with respect to an axis of rotation of the end sheave with respect to the horizontal so that the used mooring line segment or the new mooring line segment on the end sheave is aligned with the chain chute.

* * * * *